United States Patent [19]

Duda

[11] 4,290,069

[45] Sep. 15, 1981

[54] DIRECTIONAL ANTENNA FOR LONG RANGE T.V. SIGNAL RECEPTION

[76] Inventor: Philip H. Duda, 20C Scott Cir., Bedford, Mass. 01730

[21] Appl. No.: 133,716

[22] Filed: Mar. 25, 1980

[51] Int. Cl.[3] ..... H01Q 21/29

[52] U.S. Cl. ..... 343/722; 343/727; 343/807

[58] Field of Search ..... 343/722, 725, 727, 807, 343/908

[56] References Cited

U.S. PATENT DOCUMENTS 3,487,414 12/1969 Booker ..... 343/725

*Primary Examiner*—Eli Lieberman

*Attorney, Agent, or Firm*—Donald J. Singer; Willard R. Matthews, Jr.

[57] ABSTRACT

T.V. reception from transmitting stations located beyond the range commonly covered by T.V. receivers using conventional antennas is achieved by means of a highly directional bi-conical antenna structure that accommodates both VHF and UHF signals. Two truncated conductive cone antenna elements are mechanically connected at their apexes to the ends of an r.f. coil to provide the bi-conical antenna structure. The structure is horizontally positioned and rotatable for alignment with a desired station for optimum reception. A monopole antenna element is center tapped to the r.f. coil and the television UHF antenna lead is connected to the r.f. coil. The VHF antenna lead is connected to the bi-conical antenna structure.

9 Claims, 9 Drawing Figures

FIG. 1
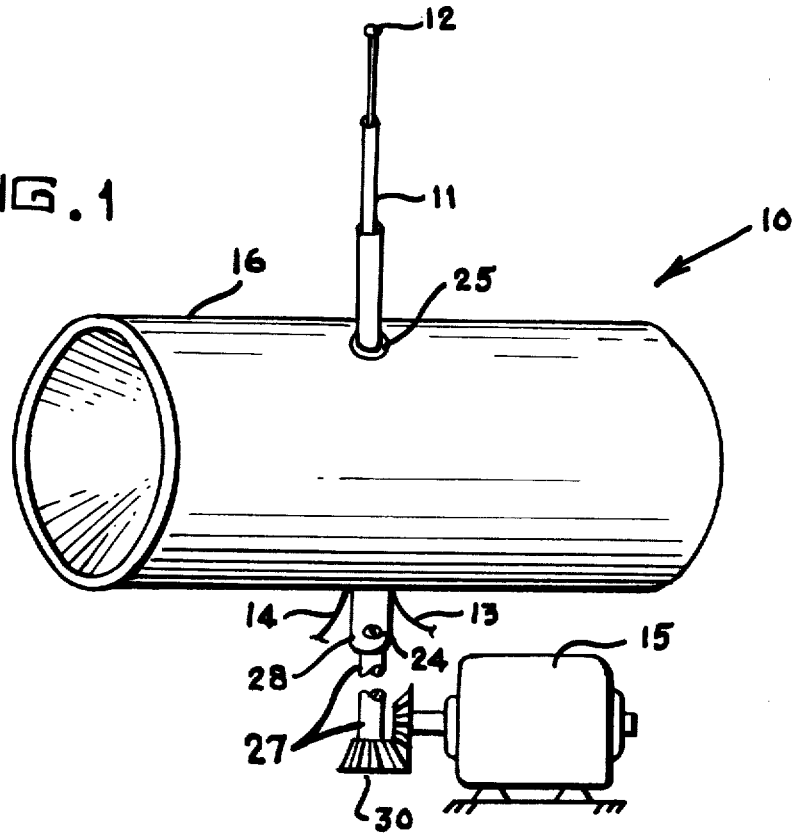
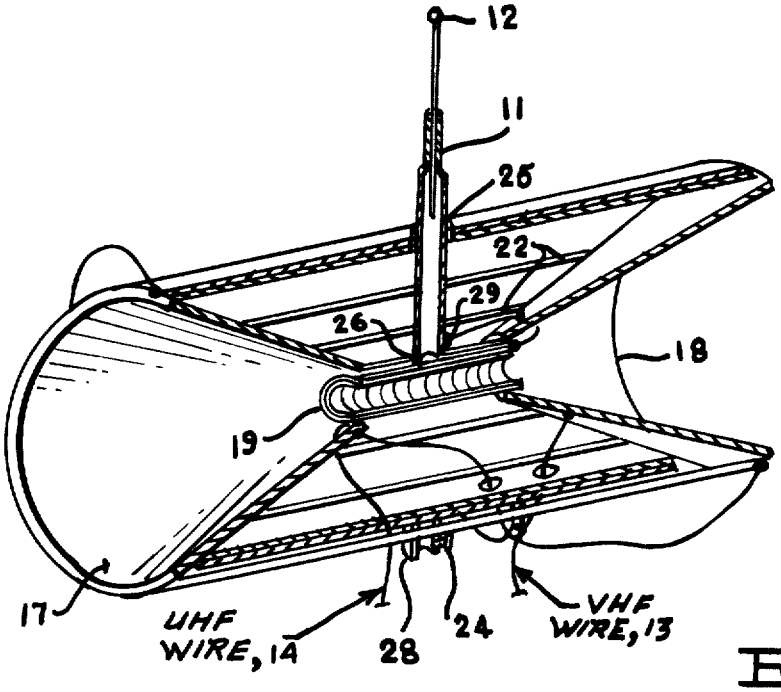
FIG. 2

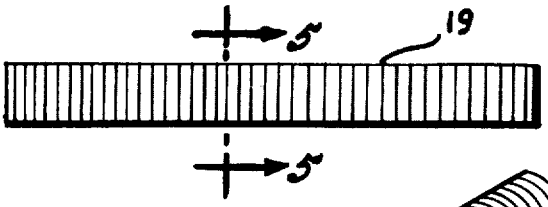
FIG. 4
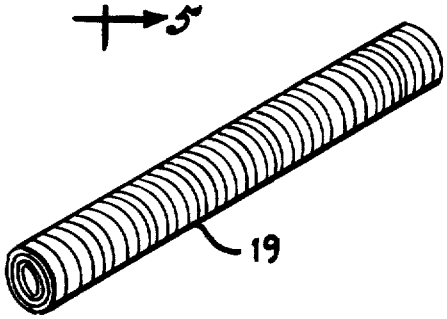
FIG. 6
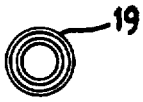
FIG. 5
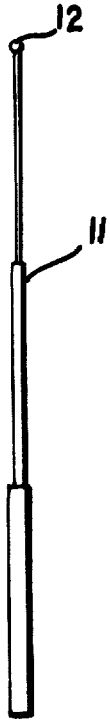
FIG. 9
FIG. 7
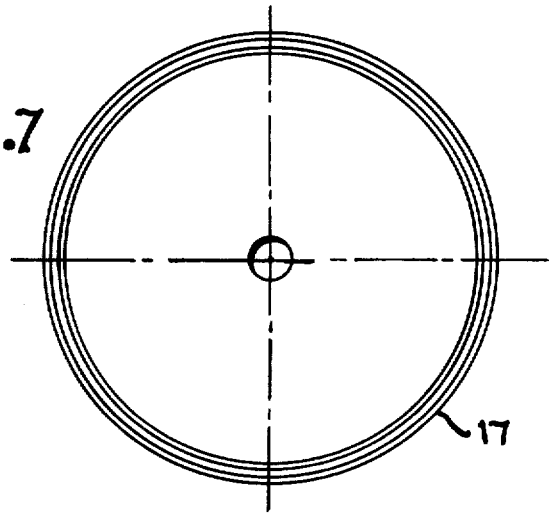
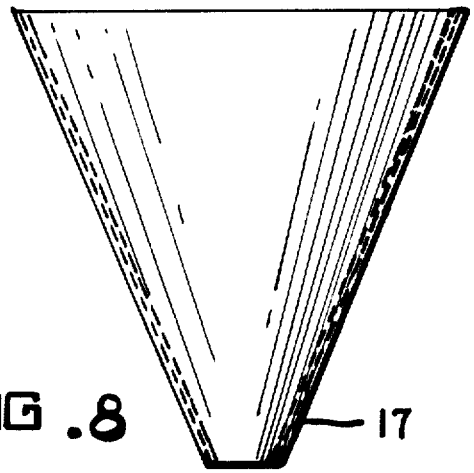
FIG. 8

DIRECTIONAL ANTENNA FOR LONG RANGE T.V. SIGNAL RECEPTION

STATEMENT OF GOVERNMENT INTEREST

The invention described herein may be manufactured and used by or for the Government for governmental purposes without the payment of any royalty thereon.

BACKGROUND OF THE INVENTION

This invention relates to the reception of television signals from remote T.V. transmitting stations and in particular to a highly directional T.V. antenna for maximizing signal reception from transmitting stations located beyond the range within which televisions using conventional antennas are able to receive viewable quality signals.

Televisions using conventional antennas such as Yagi arrays, folded dipoles and standard UHF loop antennas can receive viewable quality signals from transmitting stations within a 50–100 mile radius depending upon the strength of the transmitting station's signal. These conventional antennas are directional to a degree, that is, by rotating them into proper alignment with the transmitting station the picture quality can be measurably improved. However, their directivity and signal capturing capability is not sufficient to effectively increase the range of viewable quality reception by any significant amount. In many instances, it is desirable to view programming provided only by stations that are located beyond the range normally covered by televisions utilizing conventional antennas. In the absence of cable TV such viewing in the past has been impossible. Accordingly, there currently exists the need for means to provide good quality signal reception from T.V. stations located in an extended range that reaches substantial distances beyond the normal viewing area. The present invention is directed toward satisfying that need. Specifically, the invention provides an antenna that effectively receives good quality T.V. signals from regions beyond the normal viewing area. The invention can be used independently or in conjunction with conventional antenna systems to provide a greatly expanded T.V. viewing area.

SUMMARY OF THE INVENTION

The invention is a highly directional television antenna comprised of two truncated cones of conductive material connected at their apexes to the ends of an r.f. coil to form a bi-conical antenna structure. An extensible monopole antenna element is perpendicularly center tapped to the r.f. coil. A rutilated quartz crystal is positioned at the top of the monopole antenna element. A support structure connects the cones and is mounted such that the entire assembly is rotatable with the major axes of the cones and the r.f. coil being in a horizontal plane. The r.f. coil and the monopole antenna element are electrically insulated from the bi-conical structure. The television VHF antenna lead is connected to the support structure which is of conductive material and to the cones. The television UHF antenna lead is connected to the r.f. coil. Means are provided for rotating the antenna structure into alignment with any desired TV transmitting station.

It is a principal object of the invention to provide a new and improved television antenna.

It is another object of the invention to provide a television antenna that is highly directional and capable of receiving good quality signals from remote T.V. transmitters.

It is another object of the invention to provide a television antenna that is adapted to receive, effectively, signals from a selected remote TV transmitter and that can be rotated into alignment with the selected transmitting station.

It is another object of the invention to provide a highly directional television antenna for long range T.V. signal reception that accomodates both VHF and UHF signals.

It is another object of the invention to provide a highly directional television antenna for long range reception of T.V. signals that is inexpensive and easily fabricated.

These together with other objects, features and advantages of the invention will become more readily apparent from the following detailed description when taken in conjunction with the illustrative embodiment in the accompanying drawings wherein like elements are given like reference numerals throughout.

DESCRIPTION OF THE DRAWINGS

FIG. 1 is an isometric view of the antenna of the invention;

FIG. 2 is a cut away view of the antenna of FIG. 1;

FIG. 4 is a side view of the r.f. coil of FIG. 1;

FIG. 5 is a sectional view of the r.f. coil of FIG. 4 taken at 5—5;

FIG. 6 is an isometric view of the r.f. coil;

FIG. 7 is an end view of one cone element of the antenna of FIG. 1;

FIG. 8 is a side view of the cone of FIG. 7, and

FIG. 9 is a side view of the monopole antenna element of the antenna of FIG. 1.

DETAILED DESCRIPTION OF THE PREFERRED EMBODIMENT

Figure 3:
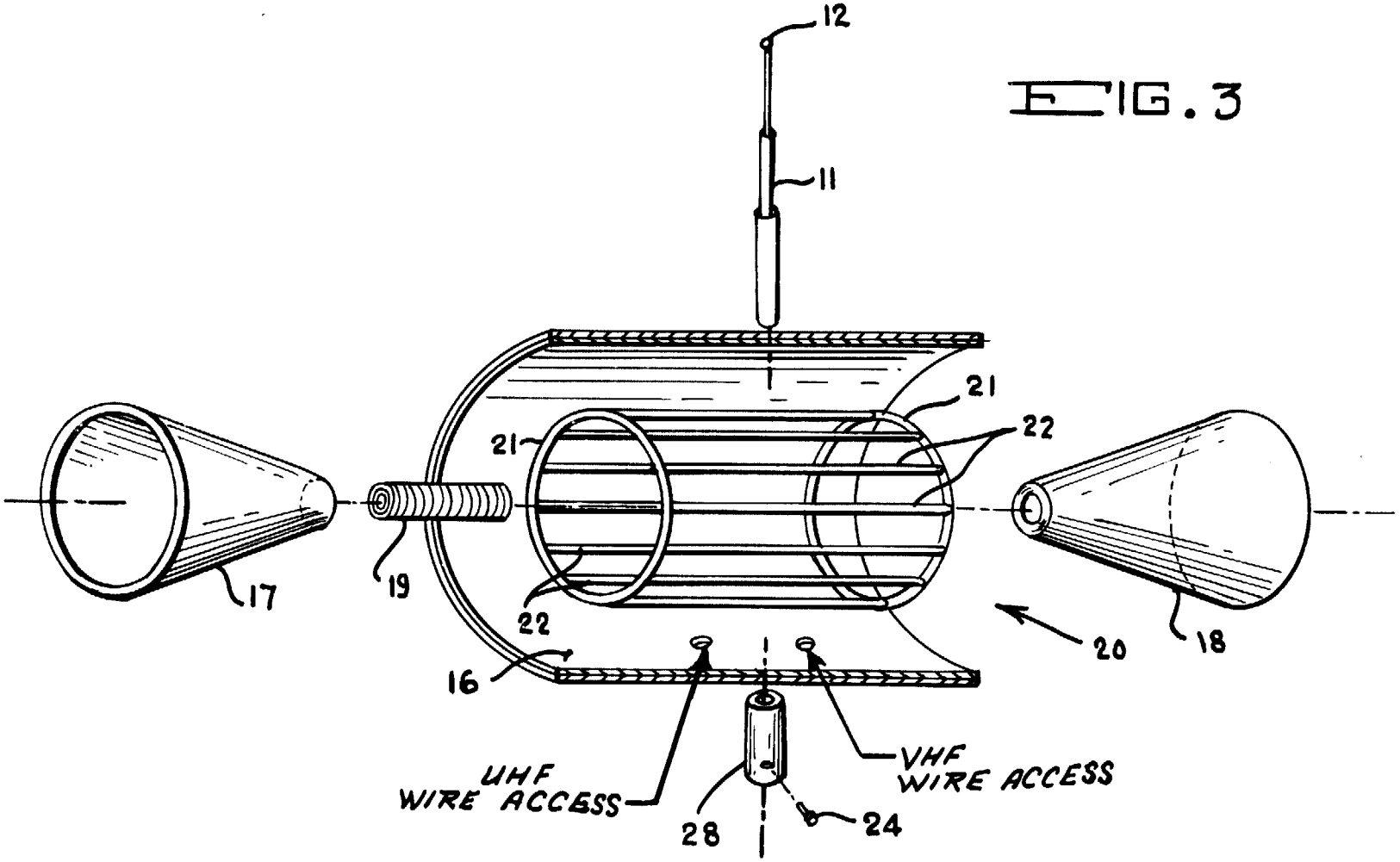
FIG. 3 is a dissected illustration of the antenna of FIG. 1 showing the individual components and their relationship to each other.

Referring now to FIG. 1 there is illustrated thereby the antenna 10 of the invention. It is mounted on base 28 that is affixed to rotating rod 27 by adjustable screw 24. Rotation of rod 27 and antenna 10 can be achieved by any suitable means such as stepping motor 15 and gear connector 30. The various components of antenna 10 together with their organization and mutual interactions are illustrated by FIGS. 2 and 3 and details of major components are illustrated by FIGS. 4–9.

Referring now to FIGS. 2 and 3 antenna 10 is seen to comprise r.f. coil 19, truncated conductive cones 17, 18, monopole antenna elements 11 and a support frame consisting of the cage of metallic rods 22 and end rings 21 and metallic tube 16. The support frame is mounted on base 28. The end cones 17, 18 are mechanically connected to the ends of r.f. coil 19 as shown. The r.f. coil 19 is fabricated of insulated wire and thus electronically insulated from the cone elements. Monopole antenna element 11 is center tapped to r.f. coil 19 by removing the wire insulation at point 26. Monopole antenna element 11 is also insulated from metallic tube 16 by means of insulator 25. The UHF antenna lead 14 from the television (not shown) is connected to one end of r.f. coil 19. The other end of r.f. coil 19 is electrically connected to the base of monopole antenna 11 at point 29. The VHF antenna lead 13 is connected to the support structure and to each cone member in two places. Monopole antenna 11 is extensible and has a rutilated quartz crystal 12 inserted onto its end.

By way of example, the cylindrical support cover of the invention can be fabricated of aluminum foil and is twelve inches in diameter and twenty-nine inches long. The monopole antenna element 11 is one foot long expandible to three feet. Cones 17, 18 which can be fabricated of aluminum foil are approximately fourteen inches long and have apex and base diameter openings of approximately one half inch and twelve inches respectively. Rods 22 and end rings 21 of the support cage can be of suitable metal such as an iron-copper-aluminum alloy. The r.f. coil 19 is an open receiver coil six inches long with an inner diameter of one half inch and consists of a three layer winding of insulated 22 gage wire. The rutilated quartz crystal 12 is crystal cut to dimensions one inch long, one-half inch thick, and two inches high. It is unflavored and the rutile spread starts centered at the base which is indented to accept the monopole antenna element tip. The crystal has a natural oscillation frequency that responds to and filters out electromagnetic interference due to solar flare action.

While the invention has been described in terms of its preferred embodiment it is understood that the words which have been used are words of description rather than words of limitation and that changes within the purview of the appended claims may be made without departing from the scope and spirit of the invention in its broader aspects.

What is claimed is:

1. In combination with a television receiver having VHF and UHF antenna leads, a directional antenna for long range television signal reception, said directional antenna comprising a cylindrical r.f. coil, a monopole antenna center tapped to said r.f. coil and extending perpendicularly therefrom, one end of said r.f. coil being connected to said UHF antenna lead and the other end being connected to the base of said monopole antenna, first and second truncated cones of conductive material, said first cone being mechanically connected by its vertex to one end of said r.f. coil and said second cone being mechanically connected by its vertex to the other end of said cone, said r.f. coil and said cones constituting a bi-conical antenna structure, a support structure connecting said truncated cones, said VHF antenna lead being connected to said support structure and to said first and second truncated cones, and means engaged to said support structure for positioning said bi-conical antenna structure in a horizontal position.

2. A directional antenna as defined in claim 1 including means for providing 360° rotation of said bi-conical antenna structure.

3. A directional antenna as defined in claim 2 including filter means on the end of said monopole antenna.

4. A directional antenna as defined in claim 3 wherein said filter means comprises a rutilated crystal.

5. A directional antenna as defined in claim 4 wherein said monopole antenna is a telescopic extension whip antenna.

6. A directional antenna as defined in claim 5 wherein said first and second truncated cones are fabricated of aluminum foil.

7. A directional antenna as defined in claim 6 wherein said support member comprises a cage of metallic rods enclosed by a cylindrical aluminum sheet, said monopole antenna extending through and electrically insulated from said aluminum sheet.

8. A directional antenna as defined in claim 7 wherein said r.f. coil comprises a three layer coil of 22 gage insulated wire having a length of approximately six inches and an inner diameter of approximately one half inch.

9. A directional antenna as defined in claim 8 wherein said first and second truncated cones are approximately fourteen inches in length and have apex and base diameter openings of approximately one half inch and twelve inches respectively.

* * * * *